United States Patent [19]

Hahn

[11] Patent Number: 4,907,344

[45] Date of Patent: Mar. 13, 1990

[54] KNIVES

[75] Inventor: Jerome S. Hahn, Boca Raton, Fla.

[73] Assignee: Richardson Sheffield Limited, Sheffield, England

[21] Appl. No.: 162,797

[22] Filed: Feb. 22, 1988

[51] Int. Cl.[4] ..... B26B 9/02

[52] U.S. Cl. ..... 30/355; 30/357

[58] Field of Search ..... 30/355, 357, 350, 351

[56] References Cited

U.S. PATENT DOCUMENTS 1,388,547 8/1921 Burns ..... 30/355

3,488,845 1/1970 Tausendfreundt ..... 30/355

*Primary Examiner*—Frank T. Yost

*Assistant Examiner*—Willmon Fridie, Jr.

*Attorney, Agent, or Firm*—King and Schickli

[57] ABSTRACT

The invention relates to knives and in particular the knives of the type of construction described and claimed in British Patent No. 2,108,887, where the blade has a V-shaped cutting edge centrally located on a parallel sided blank with the edge flat ground to one side and ground with formulations such as serrations or serrations and scallops. The object of the invention is to improve such knives by increasing the strength at the cutting edge, which objective is met by a construction where along that side of the V-shaped cutting edge provided with formulations a number of interruptions are provided in spaced relationship along the length of the cutting edge to assist cutting action, and interruptions to said formations being provided in spaced relationship along the length of the cutting edge to group said formulations into discrete lengths, and said interruptions being such as to maintain a continuous cutting edge along the length of the blade.

17 Claims, 2 Drawing Sheets

KNIVES

TECHNICAL FIELD

This invention relates to knives, and is particularly, though not necessarily exclusively concerned with domestic knives such as would be used, e.g., in the kitchen.

BACKGROUND OF THE INVENTION

It has been long recognized that the cutting performance of a knife can be enhanced or made to suit a particular cutting purpose by providing at the cutting edge a formulation such as serrations or scallops. However, whilst such formulations can improve considerably the cutting action, they have the disadvantage of not readily being resharpenable and have a tendency to tear rather than cut clean. Because the creation of formulations such as serrations or scallops involves a separate grinding step in the production of knife blades, this has the effect of increasing production costs, and yet produces a blade which may not have the total life of a conventional blade by virtue of the difficulties of resharpening. It is, therefore, most important that the production costs of a blade with edge formulations are kept to a minimum, whilst providing adequate cutting life and improved cutting performance.

The long recognition of the effect of serrating a cutting edge is shown by U.S. Pat. No. 1,911,974 where one side of a blade blank is flat ground, and the opposite side ground at an angle with serrations to produce the known chisel edge construction, where the cutting tip of the blade is co-planar with one side face of the blade. At its date, and when hand grinding was the common practice, the blade would be repeatedly presented to a relatively narrow grinding wheel to produce groups of serrations at the same time. Therefore, to assist the operative to present the knife blanks to the wheel, the blade would have been initially notched at spaced intervals along its length, the spacing of the notches being equivalent to the width of the wheel. By this, the operative had a visual reference point to assist in ensuring that on presenting the blank a second or subsequent time to a wheel, there would be no overgrinding of second serrations on serrations already formed, with the effect that would have on creating a jagged edge of impaired performance, and on visual appearance of the serrated edge. It will, therefore, be understood that the spaced notches displayed in U.S. Pat. No. 1,911,974 were not intended to, and do not take part in the cutting action of the knife, and by its nature and having a chisel edge, has the disadvantage that when cutting, the applied forces to the chisel edge made cutting in a straight vertical direction difficult, these applied forces tending to cause the blade to move in an angular direction through the substance being cut.

In U.S. Pat. No. 2,059,414, the problems associated with the chisel edge of U.S. Pat. No. 1,911,974 are avoided by generating a centre vee at one edge of a blank, by grinding both sides of the blank with serrations, at the additional cost of grinding both sides of the blank edge at the required angle. Being specifically designed for cutting bread, the proposal of U.S. Pat. No. 2,059,414 is to provide an effective saw-like structure by slotting the blank at spaced intervals along its length to provide a number of distinct teeth, and where each tooth has a sharpened forward and trailing edge, and an outer edge sharpened by the grinding of serrations to both sides as mentioned above. Whilst such a saw-tooth-like construction might function in the manner indicated to reduce or eliminate the creation of crumbs whilst cutting bread, it is a form of construction unsuited to the cutting of other substances, particularly food substances such as meat, vegetables and fruit.

A formation of cutting edge that combines the advantages of a centre cutting Y-edge edge to a knife blade, and hence the avoidance of the known disadvantages of a chisel-edge, with the provision of cutting formulations such as serrations and/or scallops, and with attendant reduced manufacturing costs is disclosed in British Pat. No. 2,108,887. Here, a continuous cutting edge is formed by providing the blade with a V-shaped cutting edge, centrally located on a parallel-sided blank, the cutting edge being flat ground to one side of the Vee and ground with formulations to the opposite side of the Vee. Such a construction has proved to be most effective in providing an exceedingly sharp cutting edge that retains its sharpness for considerable periods, and can be resharpened, by avoiding the provision of serrations to both sides of the centre cutting vee, at the additional cost involved. The further advantage of this cutting edge is its wide applicability to food substances at large.

However, extensive usage of the edge construction of British Pat. No. 2,108,887 has shown that it is capable of still further improvement, and it is the object of the present invention to provide such further improvements.

BRIEF SUMMARY OF THE INVENTION

According to the present invention, a knife comprises a blade having formulations at its cutting edge to assist the cutting action, said edge being V-shaped and centrally located on a parallel sided blank, and being flat ground to one side of the Vee and ground with formulations to the opposite side of the Vee, there being a number of interruptions to the formulations, in spaced relationship along the length of the cutting edge, to group formulations into discrete lengths, and said interruptions being such as to maintain a continuous cutting edge along the length of the blade.

It has been found in practice that with a V-shaped centrally located cutting edge, the cutting tip can be flexed during the cutting of certain substances, and flexing impairs the cutting action and can be a source of a loss of sharpness of the cutting edge. By providing interruptions which can take the form of areas where no formulations are provided, or can take the form of a number of single larger serrations, the interruptions add noticeably to the strength of the cutting edge at the tip of the Vee, assisting considerably in the prevention of flexing of the blade at the tip of the Vee as can occur particularly when cutting relatively tough materials. Both types of formulations also assist in clearing debris from the bottom of the cut being produced by the blade. Interruptions in the form of single larger serrations have the still further advantage of providing a buffer between the material being cut and the cutting edge immediately alongside each larger serration that gives protection to the cutting edge to maintain the sharpness of the cutting edge, but without impairing the cutting action, by virtue of the bottom edge of the larger serrations also having a V-shaped centrally located cutting edge in continuation of the cutting edge bearing the formulations.

Preferably, the formulations are scallops and/or serrations.

Thus, the invention utilises conventional parallel sided blanks, and has a centrally located cutting edge, with the grinding of edge formulations to one side only. Such a blade, therefore, combines relatively low costs of production with the retention of improved cutting performance.

It has been found that the angle of the V-shaped cutting edge, and the scallops and/or serrations ground to one side of the v-shaped cutting edge have a marked effect on the cutting performance of the blade. It is, therefore, an important aspect of the present invention that the V-shaped cutting edge has an included angle between 14° and 30°. Preferably the included angle lies between 16° and 22°, it being further preferred that the included angle lies between 18° and 20°.

It is yet another important aspect of the invention that serrations are ground to one side of the V-shaped cutting edge, there being from 25 to 50 serrations per inch and preferably 40 serrations per inch, between the interruptions, it being further preferred that the included angle of the serrations lies between 80° and 100° and still further preferably 90°. To ensure that the serrations do not produce a saw blade effect, great care has to be taken to produce serrations which, when viewed from the flat ground side of the blank, only marginally protrude above the general level of the edge of the blade. Because the V-shaped cutting edge is flat ground to one side, and the serrations only protrude marginally, the knife can be resharpened by regrinding by hand or otherwise, the flat ground surface of the V-shaped cutting edge.

It is a still further important aspect of the invention that in addition to serrations, scallops can be ground on the same side of the V-shaped cutting edge. Thus, to provide a general purpose knife, one scallop can be provided between adjacent, spaced interruptions, e.g. having a radius in the range 0.1" to 0.25". Preferably the radius is 0.16". The scallops may have pitch in the range 2.0 to 10 and preferably 5 T.P.I. (teeth per inch). It is further preferred that the serrations, when scallops are present, have an included angle between 50° and 90°, with a still further preference of 60°. When a heavier cutting action is required, e.g. for bread and the like, again a single scallop can be provided between spaced interruptions, and when the scallops can have a radius of 0.15 to 0.5 inch, and preferably 0.25 inch, with a scallop pitch between 1.0 and 6.0 T.P.I. and preferably 4 T.P.I., and where the serrations may be between 25 and 50 T.P.I. and preferably 33 T.P.I.

More than one scallop can be provided between spaced interruptions. Thus, to provide e.g. a carving knife, two scallops can be provided between spaced interruptions, and which may each have, at the cutting edge a radius in the range 0.625 inch to 1.25 inch and preferably 0.75 inch, and a scallop pitch in the range 1 to 4 T.P.I. and preferably 2 T.P.I. Here the serrations can be as has been mentioned above in relation to the serrated only construction or the single scallop general purpose embodiment.

BRIEF DESCRIPTION OF THE DRAWING

Four embodiments of the invention will now be described, purely way of example only, with reference to the accompanying drawings, in which.

DETAILED DESCRIPTION OF THE INVENTION

Figure 1:
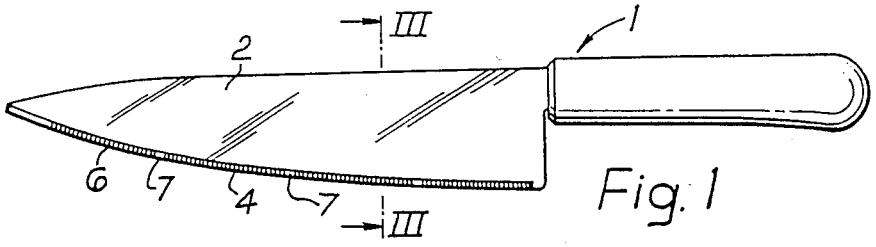
FIG. 1 is a side elevation of a knife displaying a cutting edge in accordance with one embodiment of the invention.
Figure 2:
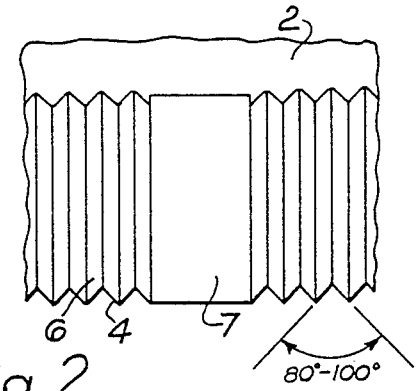
FIG. 2 is an enlarged view of part of the cutting edge of FIG. 1.
Figure 3:
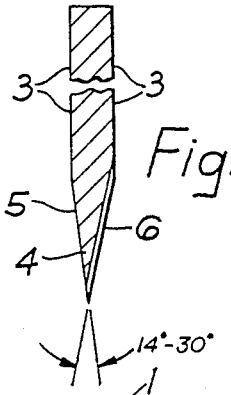
FIG. 3 is a section on the line III—III of FIG. 1.

In FIGS. 1 to 3, a knife 1 has a blade 2 with parallel sides 3 and a centrally located "V"-shaped cutting edge 4 flat ground to one side 5 and ground with serrations 6 to the other side. The "Y"-shaped cutting edge has an included angle between 14° and 30°, preferably 18° to 20° and the serrations are in the range 25 to 50 per inch, preferably 40 per inch. The included angle of the serrations at the cutting edge is between 80° and 100°, preferably 90°.

Along the length of the serrated side of the "Y"-shaped cutting edge, a number of space interruptions 7 are formed, in this embodiment by leaving a portion of that side of the "V"-shaped cutting edge unserrated. The presence of the unserrated portions or interruptions 7 adds noticeably to the strength of the cutting edge at the tip of the Vee, and provides considerable assistance in preventing any flexing of the blade at the very tip of the cutting edge particularly when cutting relatively tough materials.

Figure 4:
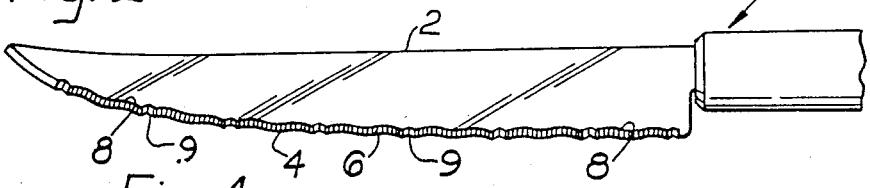
FIG. 4 is a side elevation of a knife displaying a cutting edge in accordance with a second embodiment of the invention.
Figure 5:
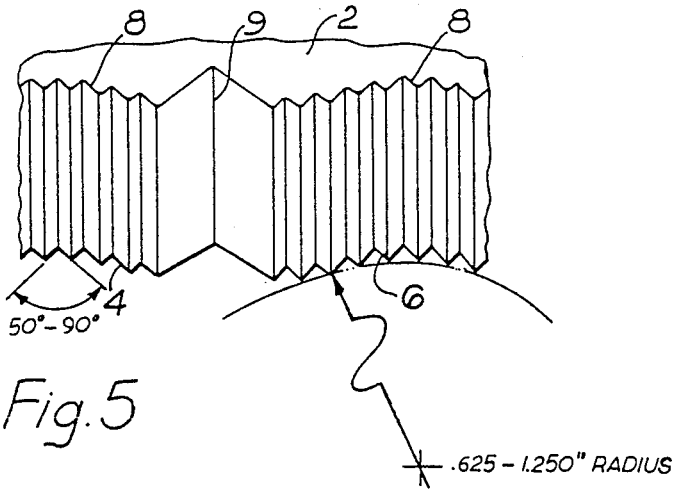
FIG. 5 is an enlarged view of part of the cutting edge of FIG. 4.

In the second embodiment illustrated in FIGS. 4 and 5 and suited to use as a carving knife, for convenience the reference numerals of FIGS. 1 to 3 have been employed for like parts. Thus, again, the knife 1 has a blade 2 with parallel sides 3 and a central V-shaped cutting edge 4 flat ground to one side 5 and formed with serrations 6 to the other side (and is in this regard essentially similar to the construction shown in FIG. 3). However, in addition to the serrations 6, that side of the V-shaped cutting edge is ground with scallops 8, each having a radius at the cutting edge between 0.625 inch and 1.25 inch preferably 0.75 inch, and a pitch in the range 1 to 4 and preferably 2 T.P.I. With such scallops present the serrations 6 have an included angle between 50° and 90°, preferably 60°. The interruptions spaced along the length of the central V-shaped cutting edge take the form of large single serrations 9. Adjacent serrations 9 contain two scallops.

Figure 6:
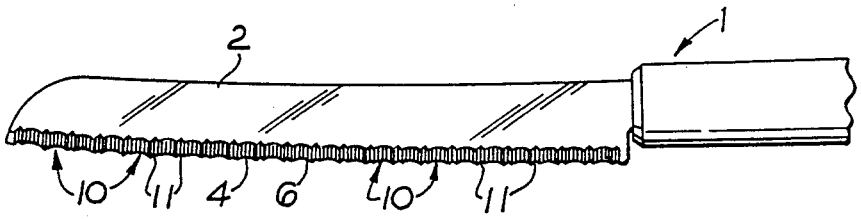
FIG. 6 is a side elevation of a third embodiment of displaying a cutting edge in accordance with the invention.
Figure 7:
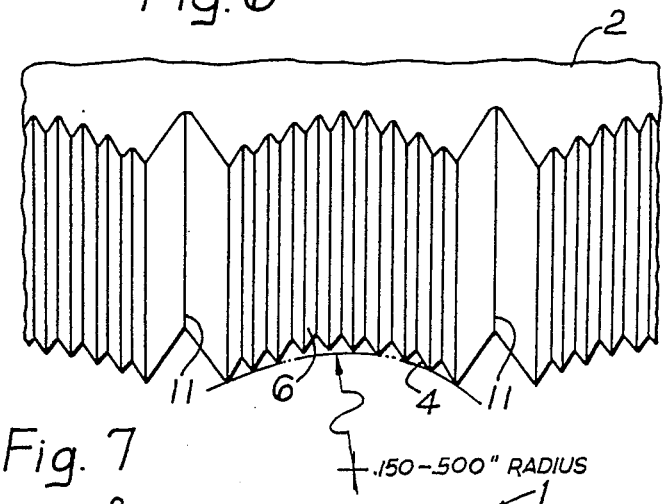
FIG. 7 is an enlarged view of part of the cutting edge of FIG. 6.

FIGS. 6 and 7 show a third embodiment suited to use as a bread knife, and here again, for convenience, the reference numerals of FIGS. 1 to 3 have been retained for like parts. Thus, the knife 1 has a blade 2 with parallel sides 3 and a central V-shaped cutting edge 4, flat ground to one side 5 and formed with serrations 6 to the other side. The serrated side of the V-shaped cutting edge being ground with scallops 10. Along the length of the cutting edge large serrations 11 are provided, there being a single scallop 10 between adjacent large serrations. Here it is preferred that the scallops have a radius at the cutting edge in the range 0.15 inch to 0.5 inch and preferably 0.25, and a scallop pitch in the range 1.0 to 6 T.P.I., preferably 4 T.P.I. The serrations 6 are preferably in the range 25 to 50 T.P.I. and further preferably, 33 T.P.I.

blade. (ere it will be understood that the cutting of paper or card is well known as a most rapid way of blunting the cutting edge of a knife. The blades were each subjected to 50 strokes across the stack of cards, and the number of cards cut by each stroke. The results of this standard test are tabulated below.

| CUT TEST: EDGE OF INVENTION | | | | | | | | | |
|---|---|---|---|---|---|---|---|---|---|
| No | CARDS | No | CARDS | No | CARDS | No | CARDS | No | CARDS |
| 1 | 50 | 11 | 51 | 21 | 53 | 31 | 50 | 41 | 51 |
| 2 | 54 | 12 | 52 | 22 | 52 | 32 | 51 | 42 | 50 |
| 3 | 53 | 13 | 53 | 23 | 52 | 33 | 51 | 43 | 50 |
| 4 | 52 | 14 | 52 | 24 | 52 | 34 | 51 | 44 | 51 |
| 5 | 53 | 15 | 51 | 25 | 51 | 35 | 50 | 45 | 52 |
| 6 | 54 | 16 | 50 | 26 | 53 | 36 | 52 | 46 | 50 |
| 7 | 52 | 17 | 51 | 27 | 51 | 37 | 52 | 47 | 50 |
| 8 | 51 | 18 | 52 | 28 | 50 | 38 | 50 | 48 | 51 |
| 9 | 51 | 19 | 51 | 29 | 52 | 39 | 51 | 49 | 50 |
| 10 | 52 | 20 | 51 | 30 | 52 | 40 | 50 | 50 | 50 |

| CUT TEST: CONVENTIONAL EDGE | | | | | | | | | |
|---|---|---|---|---|---|---|---|---|---|
| No | CARDS | No | CARDS | No | CARDS | No | CARDS | No | CARDS |
| 1 | 31 | 11 | 27 | 21 | 25 | 31 | 23 | 41 | 22 |
| 2 | 31 | 12 | 26 | 22 | 25 | 32 | 24 | 42 | 22 |
| 3 | 28 | 13 | 27 | 23 | 24 | 33 | 24 | 43 | 23 |
| 4 | 27 | 14 | 26 | 24 | 25 | 34 | 23 | 44 | 23 |
| 5 | 26 | 15 | 26 | 25 | 25 | 35 | 25 | 45 | 22 |
| 6 | 26 | 16 | 24 | 26 | 24 | 36 | 23 | 46 | 24 |
| 7 | 25 | 17 | 23 | 27 | 24 | 37 | 24 | 47 | 24 |
| 8 | 25 | 18 | 24 | 28 | 23 | 38 | 24 | 48 | 23 |
| 9 | 26 | 19 | 24 | 29 | 24 | 39 | 23 | 49 | 24 |
| 10 | 26 | 20 | 24 | 30 | 23 | 40 | 23 | 50 | 22 |

Figure 8:
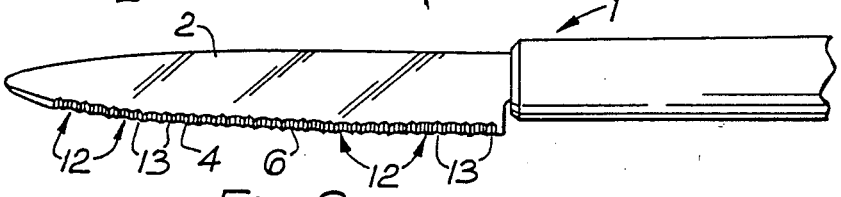
FIG. 8 is a side elevation of a fourth embodiment of knife displaying a cutting edge in accordance with the invention.
Figure 9:
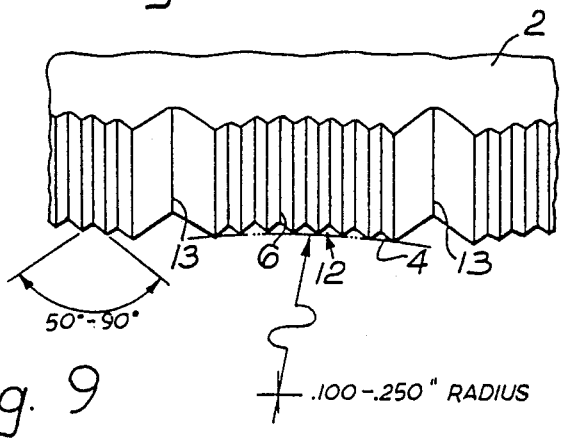
FIG. 9 is an enlarged view of the cutting edge of FIG. 8.

FIGS. 8 and 9 show a fourth embodiment suited for use as a general purpose knife. Here again the reference numerals of FIGS. 1 to 3 have been retained for like parts.

Thus, a knife 1 has a blade 2 with parallel sides 3 and a central v-shaped cutting edge 4 flat ground to one side 5 and formed with serrations 6 to the other side. The serrated side of the cutting edge is formed with scallops 12, and along the length of the cutting edge, large serrations 13 are provided with a single scallop between adjacent large serrations 13. Here it is preferred that the scallops have a radius in the range 0.1 inch to 0.25 inch, and more preferably 0.16 inch, and a pitch in the range 2 to 10 T.P.I., more preferably 5 T.P.I., the serrations having an included angle between 50° and 90°, more preferably 60°.

As with the interruptions 7 of FIG. 1, the large serrations 9 and 11 add noticeably to the strength of the blade, and are of considerable assistance in preventing flexing at the tip of the V-shaped cutting edge. The large serrations 9 and 11 have the additional advantage of providing a buffer between the material being cut and the serrations 6 immediately alongside the serrations 9 and 11 that give protection to the cutting edge without impairing the cutting action, and are effective in clearing debris from the bottom of the cut being produced. These advantages are additional to the fact that whilst the serrations 9 and 11 have an indented lower edge as shown, that lower edge has a V-shaped cutting edge in continuation of the cutting edge elsewhere on the blade.

To demonstrate the effectiveness of the cutting edge of the invention, two blades, one formed in accordance with the invention and one being a conventional serrated edge blade, were each subjected to the standard cutting test, each blade being placed in a machine to reciprocate the blade at a constant rate, with the cutting edges placed on top of a stack of identical cards, and with the identical downward load applied to each From the results given above, it will be observed that on the first stroke the blade of the invention cut through 50 cards with an average over the first five strokes of 52.4 cards cut whereas the conventional blade cut only 31, with an average over the first five strokes of 28.6 cards cut, and on the 50th stroke, the blade of the invention continued to cut through 50 cards with an average over the last five strokes of 50.2 cards cut whereas the conventional blade had cut through only 22 cards with an average over the last five strokes of 23.4 cards cut, demonstrating clearly the retention of the cutting edge by the blade of the invention and the loss of the cutting edge of the conventional blade. Equally significant is the total number of cards, 2567 by the blade of the invention in comparison with 1229 by the conventional blade.

What is claimed:

1. A knife comprising a blade in the form of a parallel sided blank, a centrally located V-shaped cutting edge on said blank having a first side that is flat ground, formulations being ground into a second side of said v-shaped cutting edge to assist cutting action, and interruptions to said formulations being provided in spaced relationship along the length of the cutting edge to group said formulations into discrete lengths the groups of formations being of greater length than the interruptions, and said interruptions each having a cutting edge and being such as to maintain a continuous cutting edge along the length of the blade.

2. A knife as in claim 1, wherein said interruptions are formed by individual serrations larger than the formulations ground into said second side of said V-shaped cutting edge.

3. A knife as in claim 1, wherein said formulations are in the form of serrations.

4. A knife as in claim 1, wherein the formulations are in the form of serrations combined with scallops.

5. A knife as in claim 1, wherein the centrally located V-shaped cutting edge has an included angle between 14° and 30°.

6. A knife as in claim 5, wherein the V-shaped cutting edge has an included angle between 16° and 22°.

7. A knife as in claim 5, wherein the V-shaped cutting edge has an included angle between 18° and 20°.

8. A knife as in claim 3, wherein there are from 25 to 50 serrations per inch, and the serrations have an included angle between 80° and 100°.

9. A knife as in claim 3, wherein there are 40 serrations per inch, and the serrations have an included angle of 90°.

10. A knife as in claim 4,. wherein one scallop is provided between spaced interruptions, the scallops having a radius in the range 0.1 inch to 0.25 inch, and a pitch in the range 2 to 10 T.P.I.

11. A knife as in claim 10, wherein the scallops have a radius of 0.16 inch, and a pitch of 5 T.P.I.

12. A knife as in claim 10, wherein the serrations have an included angle between 50° and 90°.

13. A knife as in claim 4, wherein the serrations have an included angle of 60°.

14. A knife as in claim 4, wherein a single scallop is provided between spaced interruptions, and which have a radius between 0.15 inch and 0.5 inch, with a scallop pitch between 1.0 and 6.0 T.P.I., and where the serrations are between 25 and 50 T.P.I.

15. A knife as in claim 14, wherein the scallops have a radius of 0.25 inch and a pitch of 4 T.P.I., and the serrations are 33 T.P.I.

16. A knife as in claim 4, wherein two scallops are provided between spaced interruptions, the scallops having a radius at the cutting edge in the range 0.025 inch to 1.25 inch and a pitch in the range 1 to 4 T.P.I.

17. A knife as in claim 4, wherein the scallops have a radius of 0.75 inch and a pitch of 2 T.P.I.

* * * * *

UNITED STATES PATENT OFFICE

CERTIFICATE OF CORRECTION

Patent No. 4,907,344 Dated March 13, 1990

Inventor(s) Jerome S. Hahn

It is certified that error appears in the above-identified patent and that said Letters Patent is hereby corrected as shown below:

On the title page, add:

Continuation-in-Part of Serial No. 845,605, filed March 28, 1986.

Prior to the first line of the specification, insert --This is a continuation-in-part of application Serial No. 845,605, filed March 28, 1986, now abandoned.--

Signed and Sealed this

Fourth Day of June, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,907,344

DATED : March 13, 1990

INVENTOR(S) : Jerome S. Hahn

It is certified that error appears in the above-indentified patent and that said Letters Patent is hereby corrected as shown below:

On the title page: Item 30, add priority of United Kingdom , Patent Application 8525762 filed October 18, 1985.

Signed and Sealed this

First Day of March, 1994

Bruce Lehman

*Attest:*

BRUCE LEHMAN

*Attesting Officer*

*Commissioner of Patents and Trademarks*